US006555970B2

(12) United States Patent
Schemmel et al.

(10) Patent No.: US 6,555,970 B2
(45) Date of Patent: Apr. 29, 2003

(54) BALLAST FOR GAS DISCHARGE LAMPS WITH SHUTDOWN OF THE FILAMENT HEATING

(75) Inventors: Bernhard Schemmel, Wessling (DE); Michael Weirich, Unterhaching (DE)

(73) Assignee: Patent-Treuhand-Gesellschaft fur Elektrische Glucklampen mbH, Munich (DE)

( * ) Notice: Subject to any disclaimer, the term of this patent is extended or adjusted under 35 U.S.C. 154(b) by 0 days.

(21) Appl. No.: 10/036,420

(22) Filed: Jan. 7, 2002

(65) Prior Publication Data

US 2002/0125807 A1 Sep. 12, 2002

(30) Foreign Application Priority Data

Jan. 22, 2001 (DE) ..... 101 02 837

(51) Int. Cl.[7] ..... H05B 37/02

(52) U.S. Cl. ..... 315/219; 315/224; 315/291

(58) Field of Search ..... 315/224, 291, 315/219

(56) References Cited

U.S. PATENT DOCUMENTS 6,054,815 A * 4/2000 Sugita et al. ..... 315/244

FOREIGN PATENT DOCUMENTS

EP 0 748 146 6/1996

* cited by examiner

*Primary Examiner*—David Vu

(57) ABSTRACT

An electronic ballast for discharge lamps with electrode filaments. The ballast contains a frequency-selective device, which suppresses an auxiliary heating current in the electrode filaments during operation of the lamp. Heating of the electrode filaments is possible only within a narrow frequency band.

11 Claims, 2 Drawing Sheets

BALLAST FOR GAS DISCHARGE LAMPS WITH SHUTDOWN OF THE FILAMENT HEATING

TECHNICAL FIELD

The invention is based on an electronic ballast according to the preamble of claim 1.

An electronic ballast principally contains an AC voltage generator, which provides an AC voltage of an oscillation frequency that is substantially higher than the frequency of the mains voltage. Through suitable means, the electronic ballast must start an attached discharge lamp and subsequently make it operate. The starting of a discharge lamp with electrode filaments can be subdivided into preheating and ignition. For preheating, a current flows through the electrode filaments and brings them to a temperature which allows subsequent ignition that entails only minor damage to the electrode filament. Once the discharge lamp has been ignited, the operation of the discharge lamp begins. In this state, the current for the gas discharge in the lamp is supplied via the electrode filament terminals. A current which flows in at one electrode filament terminal is then divided into a part that flows into the gas discharge and a part that flows out again at the other terminal of the same electrode filament. The part of the current which does not flow into the gas discharge causes additional heating of the electrode filament in relation to the gas discharge, for which reason this current is referred to as an auxiliary heating current. In discharge lamps with fragile electrode filaments, this auxiliary heating current must be low in order to achieve a long life. It is therefore expedient for the electrode filaments to carry essentially the gas discharge current during operation. The auxiliary heating current should be small compared with the current for the gas discharge (at most 20%).

PRIOR ART

The document EP0748146 (Krummel) proposes a heating transformer for the preheating. The AC voltage generator feeds the preheating current into its primary winding. Each electrode filament is attached to a secondary winding of the heating transformer. A switch can be used to interrupt the flow of current in the primary winding of the heating transformer. This makes it possible to prevent any auxiliary heating current from flowing during operation, so that the electrode filaments carry essentially the gas discharge current. However, this solution requires a switch and the system needed for actuating it.

DESCRIPTION OF THE INVENTION

It is an object of the present invention to provide an electronic ballast according to the preamble of claim 1, which does not need a switch for turning off the preheating and is therefore less expensive than the aforementioned solution.

This object is achieved, in the case of an electronic ballast having the features of the preamble of claim 1, by the features of the characterizing part of claim 1. Particularly advantageous configurations are given in the dependent claims.

According to the invention, the electronic ballast contains a frequency-selective device, which permits preheating of the electrode filaments only if the oscillation frequency of the electronic ballast is within a narrow frequency band, which is determined by the frequency-selective device. The frequency-selective device is preferably formed by a tuned circuit consisting of an inductor L and a capacitor C. The electronic ballast's oscillation frequency, at which preheating is then possible, is given by the resonant frequency of this tuned circuit, where:

$$f_{res} = \frac{1}{2\pi\sqrt{LC}}$$

Of course, it is not necessary to comply exactly with this frequency. Instead, it is sufficient for the electronic ballast's preheating oscillation frequency to be within a narrow frequency band around the resonant frequency fres. In practice, it has been found that a frequency band of +/−10% around the resonant frequency is sufficient.

The inductor of the tuned circuit may, according to the invention, be formed by the primary inductor of the heating transformer. That is to say, the inductor which constitutes the primary winding of the heating transformer, together with a series resonance capacitor connected in series or a parallel resonance capacitor connected in parallel, forms the tuned circuit. In principle, the tuned circuit may also be formed on the secondary side of the heating transformer. Since the impedance level is lower there, however, high resonant currents that constitute a high component load are produced.

In order to be able to form a sufficiently high primary inductance, a heating transformer with loose coupling may be selected.

Since the AC voltage generator of the electronic ballast often delivers a square-wave voltage, the tuned circuit can also be excited by harmonics. Since, according to the invention, no auxiliary current is meant to flow during operation of the lamp, the electronic ballast must not, at the operating frequency, excite the tuned circuit with a harmonic. The term "operating frequency" is intended to mean the oscillation frequency at which the electronic ballast functions during operation of the lamp. Since a square-wave oscillation has only odd harmonics, the tuned circuit is configured, according to the invention, in such a way that its resonant frequency will be at, or close to, two times the operating frequency. The inventive concept is still achieved if the resonant frequency fres of the tuned circuit is two times the operating frequency to within a tolerance of +/−20%.

DESCRIPTION OF THE DRAWINGS

The invention will be explained in more detail below with reference to several exemplary embodiments.

Capacitors are denoted below by letters C, inductors by L, and transformer windings by T, in each case followed by a number.

Figure 1:
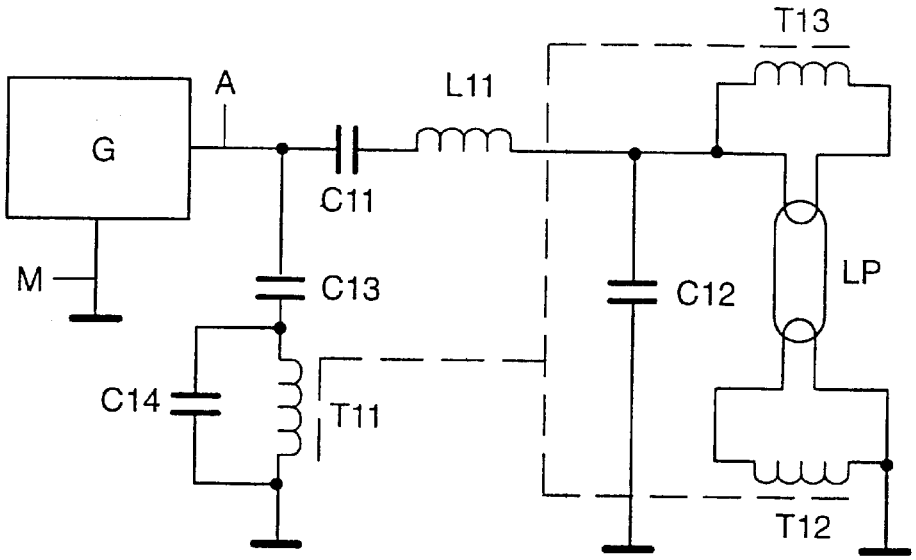
FIG. 1 shows the electronic ballast with a lamp attached and a parallel resonance capacitor according to the invention.

FIG. 1 represents an electronic ballast with a discharge lamp LP attached. The AC voltage generator G delivers an AC voltage, with respect to a ground potential M, at an output A. The frequency of the AC voltage is substantially higher than the mains frequency. Between the output A and the ground potential M, there is the series circuit consisting of a coupling capacitor C11, a lamp reactor L11 and an ignition capacitor C12, one terminal of C12 being joined to the ground potential M. C11 is used to remove any existing DC component of the AC voltage supplied by the AC voltage generator G. L11 is used to match the discharge lamp LP to the AC voltage generator G. C12 is primarily used to generate an ignition voltage for igniting the discharge lamp LP. C12 can be used together with L11 for matching the discharge lamp LP to the AC voltage generator G. The discharge lamp LP is connected, respectively by one electrode filament terminal on each side, in parallel with C12.

Between the output A and the ground potential M, there is the series circuit consisting of a trapezoidal capacitor C13 and a tuned circuit according to the invention. The tuned circuit consists of the parallel connection of a parallel resonance capacitor C14 and the primary winding T11 of a heating transformer. The trapezoidal capacitor C13 is used for coupling the tuned circuit to the AC generator G. C13 can also be used for switch relief of switches that are contained in the AC generator G. The tuned circuit, consisting of C14 and T11, has a resonant frequency fres1, which can be calculated by using the formula given above. The effective primary inductance at the primary winding T11 of the heating transformer is to be used for the inductance L indicated in the formula. According to the invention, the heating transformer can be designed with loose coupling, in order to achieve sufficiently high values for the primary inductance. The heating transformer has, for each electrode filament, a secondary winding T12 and T13 connected thereto. The resonant frequency fres1 is configured, according to the invention, in such a way that it is close to two times the operating frequency. At the operating frequency, the impedance of the tuned circuit hence has a low value compared with the impedance of C13. Only a small voltage is therefore applied to the primary winding T11, and only a negligibly small auxiliary heating current is fed into the electrode filaments. For preheating, according to the invention, the AC voltage generator G delivers a voltage whose frequency is close to the resonant frequency fres1. A high current hence flows in the primary winding T11 of the heating transformer and is transmitted to the secondary windings T12 and T13 for the preheating.

Figure 2:
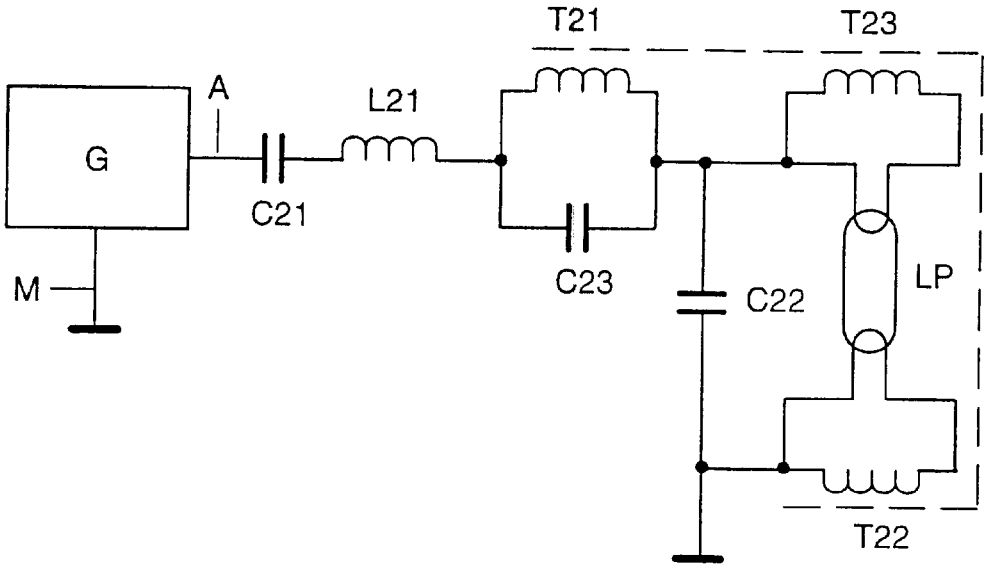
FIG. 2 shows another exemplary embodiment with a parallel resonance capacitor according to the invention.
Figure 3:
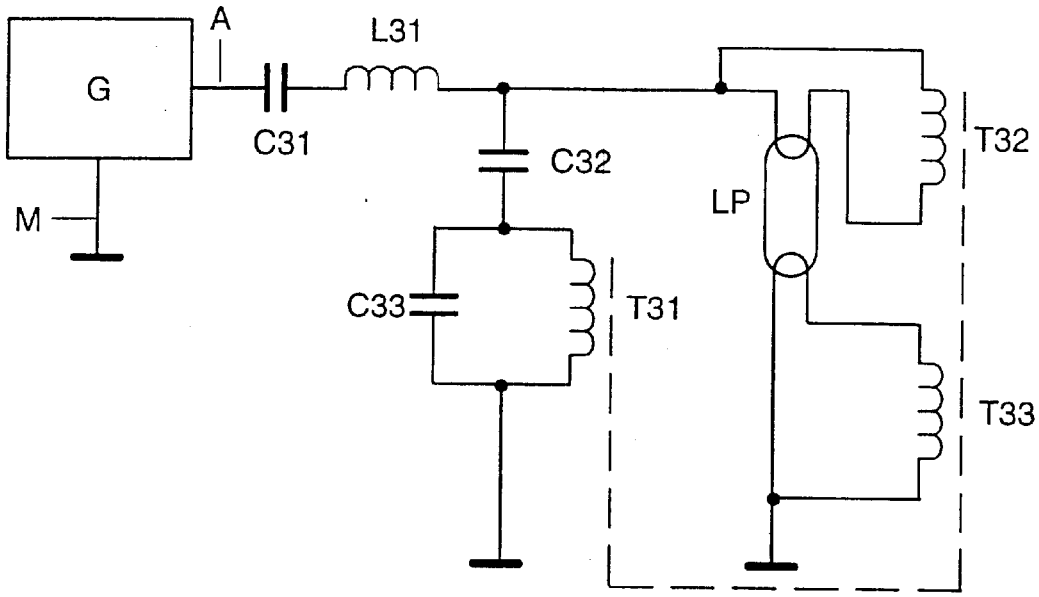
FIG. 3 shows another exemplary embodiment with a parallel resonance capacitor according to the invention.

In FIGS. 2 and 3, the trapezoidal capacitor C13 of FIG. 1 is omitted. Optionally, a trapezoidal capacitor may also be connected between the output A and the ground potential M in FIGS. 2 and 3, for the aforementioned switch relief. Since the respective tuned circuits T21/C23 and T31/C33 in FIGS. 2 and 3 do not receive a square-wave current from the AC voltage generator G, but instead, owing to the respective lamp reactors L21 and L31, they receive only an almost sinusoidal current, the resonant frequency fres1 of the tuned circuit T21/C23 and T31/C33 need not be close to two times the operating frequency.

Another difference between FIG. 1 and FIG. 2 is that the tuned circuit, consisting of T21 and C23, in FIG. 2 is connected in series with the coupling capacitor C21. Further, the comments regarding FIG. 1 apply correspondingly.

The difference between FIG. 2 and FIG. 3 is that the tuned circuit, consisting of T31 and C33, in FIG. 3 is connected in series with the ignition capacitor C32. The comments regarding FIG. 1 also apply in FIG. 3.

Figure 4:
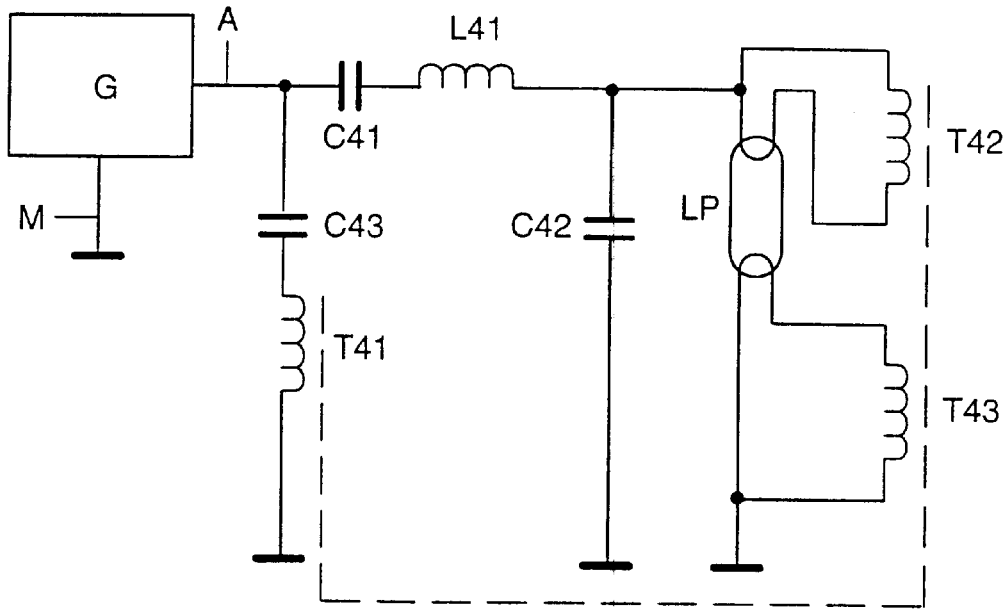
FIG. 4 shows another exemplary embodiment with a series resonance capacitor according to the invention.

In FIG. 4, unlike FIGS. 1 to 3, the tuned circuit according to the invention is configured not as a parallel tuned circuit, but instead as a series tuned circuit. It is formed by the series connection of a series resonance capacitor C43 and the primary winding of the heating transformer T41. At the operating frequency, the impedance of the primary inductance at T41 has a low value compared with the impedance of C43. Only a small voltage is therefore applied to the primary winding T41, and only a negligibly small auxiliary heating current is fed into the electrode filaments. In other regards, the comments regarding FIG. 1 apply correspondingly.

No special advantages of one exemplary embodiment over another can be given.

Each of the exemplary embodiments is equipped with one lamp. The invention can, however, also be applied to applications with a plurality of lamps by using techniques which are familiar to a person skilled in the art and are known from the prior art.

What is claimed is:

1. An electronic ballast for preheating, igniting and operating discharge lamps (LP), in which the electrode filaments of attached discharge lamps (LP) carry essentially the gas discharge current during operation, characterized in that the electronic ballast contains a frequency-selective device, which permits preheating of said electrode filaments only if the oscillation frequency of the electronic ballast is within a narrow frequency band, which is determined by the frequency-selective device.

2. The electronic ballast as claimed in claim 1, characterized in that the frequency-selective device contains a heating transformer (T11/T12/T13, T21/T22/T23, T31/T32/T33, T41/T42/T43).

3. The electronic ballast as claimed in claim 2, characterized in that the heating transformer (T11/T12/T13, T21/T22/T23, T31/T32/T33, T41/T42/T43) is designed with loose coupling.

4. The electronic ballast as claimed in claim 2, characterized in that a series resonance capacitor (C43) is connected in series with the primary winding (T41) of the heating transformer.

5. The electronic ballast as claimed in claim 4, characterized in that the series resonance capacitor (C43) together with the primary inductor of the heating transformer has a resonant frequency which is close to two times the value of the oscillation frequency, at which the electronic ballast oscillates during the operation of attached discharge lamps (LP).

6. The electronic ballast as claimed in claim 2, characterized in that a parallel resonance capacitor (C14, C23, C33) is connected in parallel with the primary winding of the heating transformer (T11, T21, T31).

7. The electronic ballast as claimed in claim 6, characterized in that the parallel resonance capacitor (C14, C23, C33) together with the primary inductor of the heating transformer has a resonant frequency which is close to two times the value of the oscillation frequency, at which the electronic ballast oscillates during the operation of attached discharge lamps (LP).

8. The electronic ballast as claimed in claim 6, characterized in that the primary winding (T31) of the heating transformer is connected in series with an ignition capacitor (C32).

9. The electronic ballast as claimed in claim 6, characterized in that the primary winding (T11) of the heating transformer is connected in series with a trapezoidal capacitor (C13).

10. The electronic ballast as claimed in claim 6, characterized in that the primary winding (T21) of the heating transformer is connected in series with a coupling capacitor (C21).

11. A method for preheating, igniting and operating discharge lamps (LP) with an electronic ballast, characterized in that, for the preheating, the electronic ballast functions at an oscillation frequency which is within a frequency band in which a frequency-selective device of the electronic ballast permits preheating, for the ignition, the electronic ballast functions at an oscillation frequency at which a voltage that leads to ignition of the discharge lamps is generated at the discharge lamps, for the operation of the discharge lamps, the electronic ballast functions at an oscillation frequency which is within a frequency band in which the frequency-selective device of the electronic ballast suppresses an auxiliary heating current.

* * * * *